United States Patent [19]

Scharnweber et al.

[11] Patent Number: 4,865,003

[45] Date of Patent: Sep. 12, 1989

[54] METHOD AND APPARATUS FOR ACTIVATING FUEL PRIOR TO COMBUSTION

[75] Inventors: David H. Scharnweber, Milford; Lyle O. Hoppie, West Bloomfield; Donald R. Haefner, Oak Park, all of Mich.

[73] Assignee: Eaton Corporation, Cleveland, Ohio

[21] Appl. No.: 290,976

[22] Filed: Dec. 28, 1988

[51] Int. Cl.[4] ..... F02M 51/00; F02M 33/00

[52] U.S. Cl. ..... 123/538; 239/708

[58] Field of Search ..... 123/538, 536; 239/708, 239/690, 486, 464

[56] References Cited

U.S. PATENT DOCUMENTS

| | | | |
|---|---|---|---|
| 4,077,374 | 3/1978 | Willmann et al. | 239/708 |
| 4,120,456 | 10/1978 | Kimura et al. | 239/464 |
| 4,176,637 | 12/1979 | Cole | 123/538 |
| 4,192,466 | 3/1980 | Tanasawa et al. | 239/464 |
| 4,203,398 | 5/1980 | Maruoka | 123/538 |
| 4,380,978 | 4/1983 | Maynard et al. | 123/538 |

*Primary Examiner*—Willis R. Wolfe
*Assistant Examiner*—M. Macy
*Attorney, Agent, or Firm*—John R. Benefiel

[57] ABSTRACT

Fuel is activated prior to combustion in an engine by an electrical arc established across an annular gap between two electrodes, and sustained for a significant portion of the injection cycle. The vaporized or gaseous fuel is directed through a spiral recess to be caused to flow vortically and cause the arc to migrate about the annular gap to reduce electrode erosion and increase exposure of the fuel to the activating effects of the arc. The arc is formed by separating contacting electrodes which applying a current to the electrodes. One of the electrodes is movable under the influence of the pressurized fuel to cause separation from the other fixed electrode, so that the arc is established as fuel begins flowing. The electrodes have opposing rimmed cavities, with fuel flow shifting the arc radially inwardly, migrating to extend between the inner wall of each cavities, and around which the arc rotates under the influence of the vortical fuel flow.

29 Claims, 4 Drawing Sheets

METHOD AND APPARATUS FOR ACTIVATING FUEL PRIOR TO COMBUSTION

FIELD OF THE INVENTION

This invention concerns combustion devices such as internal combustion engines in which fuel in a gaseous or vaporous state is burned in a combustion chamber to produce engine power.

BACKGROUND OF THE INVENTION

There has heretofore been developed arrangements for "activating" hydrocarbon fuels prior to combustion in a combustion device by generating radicals of the fuel molecules. This activation reduces ignition delay and allows greater control over the combustion process, and the activation process itself may be employed as an ignition mechanism.

Activation of fuel by formation of radicals may be carried out to a degree in which a sufficiently high concentration of radicals results in negligible ignition delay and the fuel combusts substantially instantaneously when introduced into an oxidizing atmosphere. This combustion of such highly activated fuel is referred to as "hypergolic" combustion, and activation to such levels has heretofore been described as being able to be accomplished in various ways.

In U.S. Pat. No. 4,448,176 assigned to the same assignee as the present application, there is described an activation process in which fuel is heated to very high levels, i.e., to temperatures on the order of 1000° F., to achieve fuel activation resulting in hypergolic combustion when the fuel is introduced into an oxidizing atmosphere.

Various other patents also assigned to the same assignee describe fuel charge activation by electrical discharge, of irradiation by UV and laser beams, heating by compression, as well as catalytic pretreatment of the fuel.

As a particular example, U.S. Pat. No. 4,582,475 describes activation by passing the fuel through an electric field generating a corona, to provide an ignition device by activation of the fuel molecules to an extent sufficient to establish ignition. While suitable as an ignition device, it has been found that the rate of formation of radicals by a corona alone is too low to activate an entire fuel charge for a cyclically operated combustion device such as an internal combustion engine.

It is noted that the persistence of the radicals is short such that injection into an oxidizing atmosphere must occur almost immediately upon activation.

As another example, U.S. Pat. No. 4,672,938 discloses a multiphasic pretreatment of fuel to be burned in an engine, including passing the fuel through an electric discharge, suggested as a corona or an electrical arc.

The localized activation of fuel and air by an arc, as in a spark plug, is inherent in conventional spark ignition. However, there has not heretofore been provided a system for activating more than a minute proportion of a fuel charge by an electrical arc. Such a system would have to expose a substantial proportion of the fuel charge to the arc with an intensity effective to activate such proportion of fuel passed through the system and mix the radicals through the fuel charge to achieve a uniform combustion event. Since the duration of the arc would have to be sustained for a much longer period than in conventional arc ignition systems, electrode erosion is potentially a severe problem, as the metal of the eletrodes would reach elevated levels sufficient to liquify and/or vaporize portions thereof, and to migrate away. This is particularly so for the initially high current levels found in conventional systems when very high voltages are applied, i.e. 25,000 volts or higher needed to jump the spark gap and establish the arc.

The object of the present invention is to provide an arrangement for activating a fuel charge by means of a sustained electrical arc which rapidly activates a substantial proportion of a fuel charge by exposure to the electrical arc while avoiding the electrode erosion problem. This arrangement is thereby adapted to supply activated fuel for hypergolic combustion in an internal combustion engine.

SUMMARY OF THE INVENTION

This and other objects of the invention which will become apparent upon a reading of the following specification and claims are accomplished by establishing an electrical arc within a space defined between two electrodes, which arc is sustained for a substantial portion of the injection cycle, and causing the sustained arc to be swept about said space, while fuel is caused to be passed through the space immediately prior to injection into a combustion chamber as of an internal combustion engine.

The shifting movement of the arc in the space subjects a much greater proportion of the fuel to the activating effect of the arc while greatly reducing the erosion of the electrodes.

The movement of the arc through the space is preferably caused by a vortical flow of the fuel through said space acting on the arc to produce rotation of the arc around annular electrode surfaces defining the gap space. The vortical flow establishes a low pressure region along the centerline, tending to stablize the arc at this location. The tangential component of the flow results in a greatly increased proportion of the fuel being exposed to the activating effect of the arc and mixes the radicals throughout the fuel charge.

Preferably, an arc striking arrangement is utilized comprised of a relatively shiftable mounting of the electrodes, in which the electrodes have surface portions initially positioned in contact with each other preparatory to an injection cycle, with a current flowing through the contacting electrodes. The electrodes are subsequently drawn apart at the beginning of the fuel flow enabling an arc to be established between the separated electrode portions with a low voltage source, i.e., 200–800 v, which greatly simplifies the power supply.

The separation of the electrodes is preferably brought about by movably mounting one of the electrodes and subjecting it to pressurized fuel to overcome a spring acting to urge the electrodes into contact, the fuel pressure causing the movable electrode to move away from the other relatively fixed electrode, and the applied current causing an arc to be established across the resulting gap.

The fixed electrode preferably has an open ended cavity recessed into one end facing the relatively movable other electrode, which likewise is formed with an aligned facing open ended cavity, with the rims of each cavity comprising the contacting portions of the electrodes. The arc is initially established across the separated annular rims of the electrodes, but is shifted onto the axially extending walls of the cavities and rotates therearound under the influence of the vortical flow of the fuel.

The electrodes are designed to automatically compensate for electrode end face wear by a clearance allowing continuing travel of one of the electrodes into contact with the other as continuing wear occurs.

The activated fuel passes down one of the cavities and out through tangentially extending jet orifices in being injected into the combustion chamber.

In a second embodiment, a proportion of fuel is bypassed from passing through the gap space and past the arc in order to reduce the aerodynamic effect of the fuel flow on the arc, if necessary. This is accomplished by establishing secondary fuel flow paths external of the electrodes which is subsequently directed into the activated fuel flow to mix the same prior to combustion.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
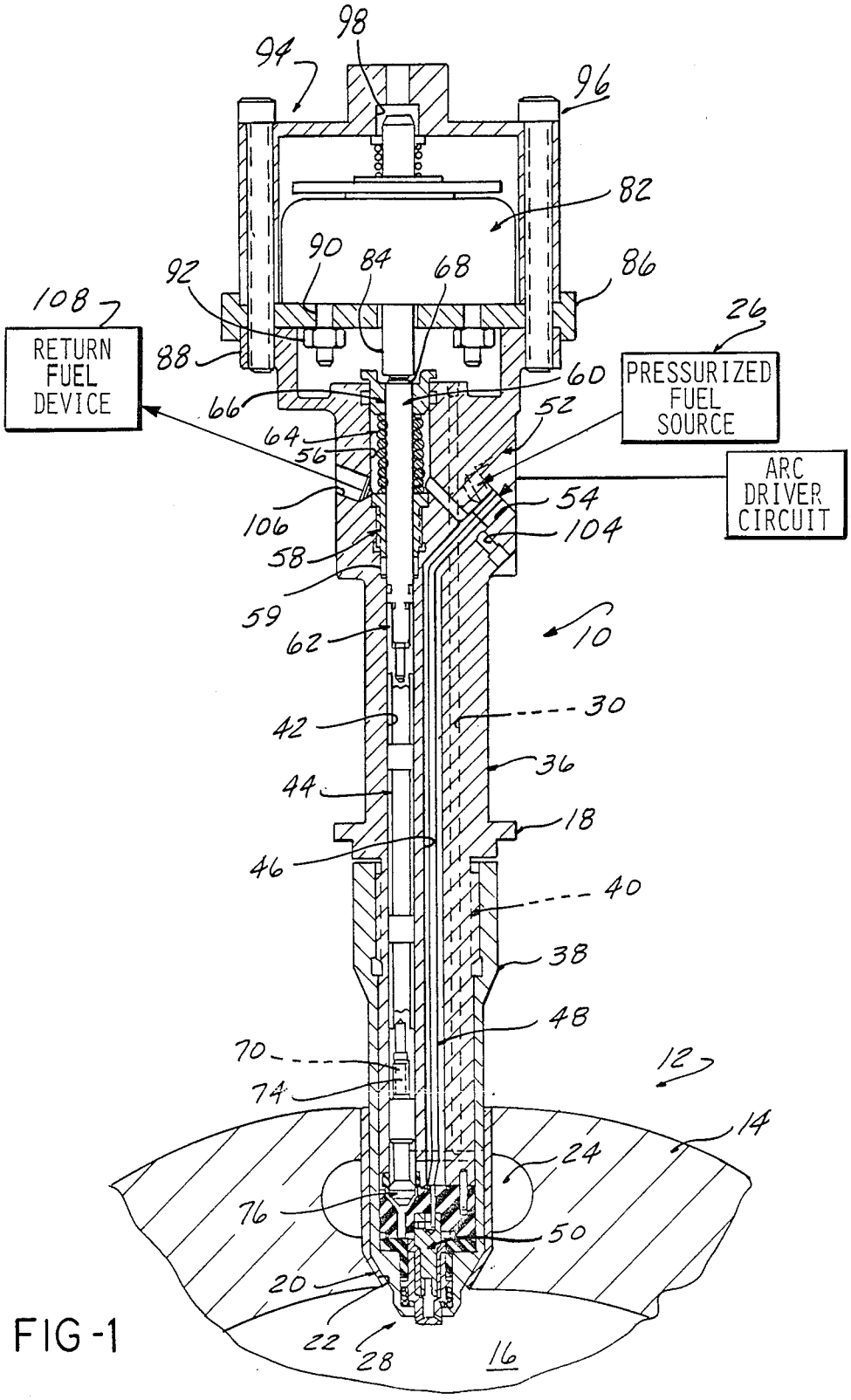
FIG. 1 is a lengthwise sectional view of an apparatus according to the present invention, with a fragmentary sectional view of a combustion chamber into which the injector is installed.

Referring to FIG. 1, the fuel activating apparatus according to the present invention here takes the form of a fuel injector 10, and is shown installed in a combustion device 12, i.e., in the head 14 of an internal combustion engine having a combustion chamber 16.

The injector 10 may be held in place by means of well known clamping devices (not shown) acting on a clamping flange 18 to force a tapered sleeve 20 into a tapered seat 22. A coolant passage 24 may be provided to directly expose sleeve 20 to cooling fluid, in a manner well known in connection with diesel engine fuel injectors. An oxidizer, such as atmospheric air, is admitted to the combustion chamber 16 during each engine cycle, and the products of combustion expelled after each cycle as by conventional valving means (not shown).

Vaporized fuel is supplied under pressure from a source 26. The fuel may be vaporized gasoline or diesel fuel, or a gas such as methane under sufficient pressure to be injected into air compressed in the combustion chamber 16. Suitable compressors are well known in the field able to supply vapor or gaseous fuel at 1500–3000 psig, with 40–50 SCFM required for a typical multicylinder engine, and will not be described here.

The fuel is adapted to be injected from the tip end 28 of the injector 10, properly timed with respect to the engine cycle by means of electromechanical valving (described herein) contained within the injector 10 controlling communication between an internal fuel passage 30 with the combustion chamber 16 to control the flow of fuel thereinto.

The injector 10 is constructed of two major pieces, an upper housing member 36 having the holding flange 18 integral therewith, and an outer retainer sleeve 38 threaded at 40 onto the housing member 36. A tapered sleeve 20 is received over the exterior of the retainer sleeve 38 and held in position by the clamping mechanism (not shown), preferably constructed of copper to have good thermal conductivity. Housing member 36 is formed with three lengthwise bores, a first bore 30 constituting a fuel passage, a second bore 42 receiving a segmented valve operating rod assembly 44 and a third bore 46 through which a power cable 48 passes to be connected to an electrode 50.

The fuel passage 30 connects to a port 52 adapted to receive a suitable fitting (not shown), while electrode passage 46 extends to a cross bore 54 exiting the housing member 36.

Figure 2:
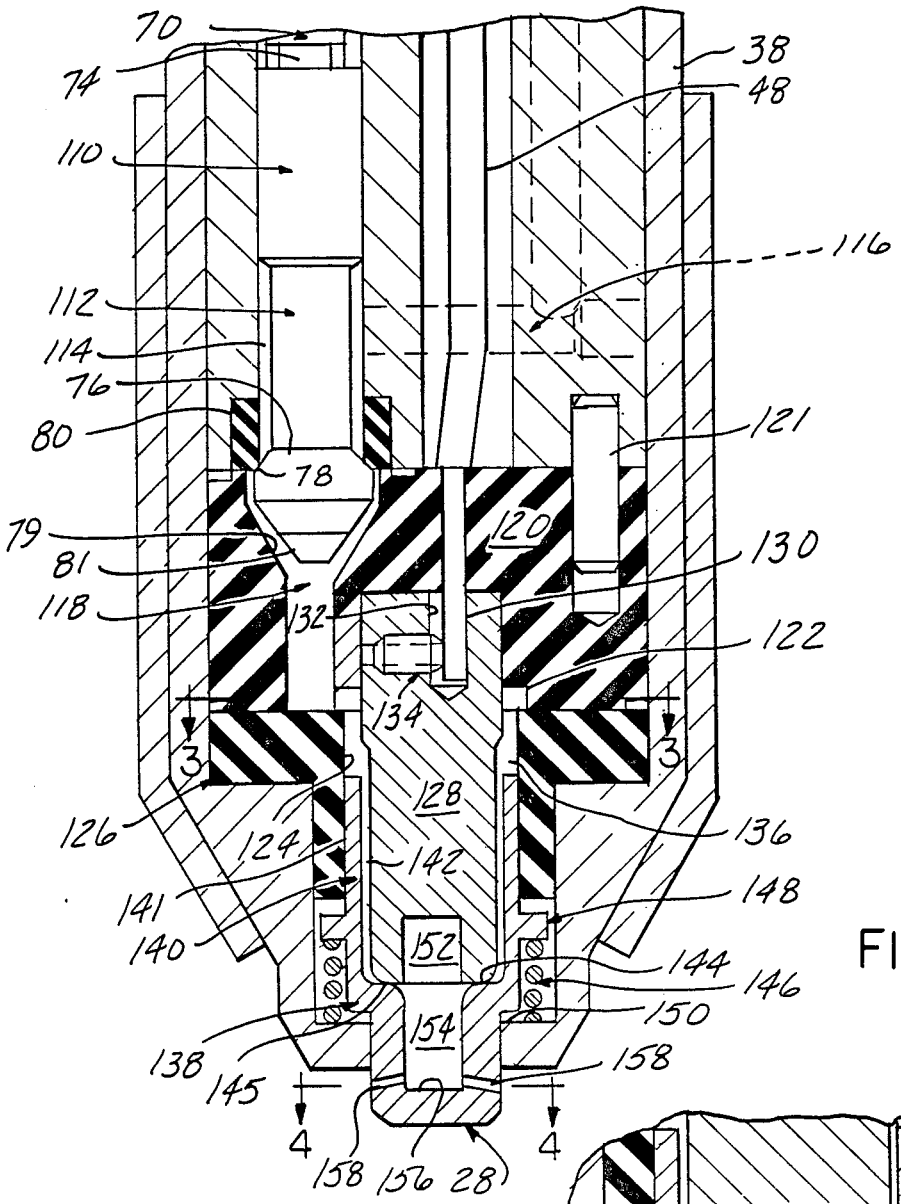
FIG. 2 is an enlarged view of the apparatus shown in FIG. 1.
Figure 4:
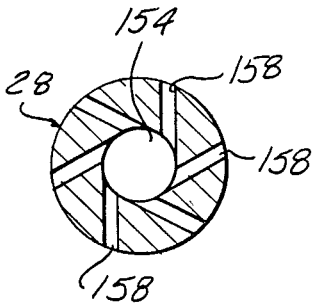
FIG. 4 is an enlarged view of the transverse section 4—4 taken in FIG. 2.

The second bore 42 enters into an enlarged bore 56 receiving a bushing 58, which retains high pressure seal, 59 in turn guiding movement of a plunger pin 60 threaded at 62 to the segmented valve operator rod 44. A compression spring 64 bears against a flange piece 66 held with a snap ring 68 to urge the plunger pin 60 and operator rod 44 upwardly. As shown in FIGS. 1 and 2, the segmented actuator rod 44 is threaded at 70 to the stem 74 of a generally conical valve member 76 which seats against an annular surface 78 of a valve seat 80 under the urging of the compression spring 64.

A solenoid 82 has an operator rod 84 bearing against the plunger pin 60 and is advanced downward upon energization thereof, so that the force of the compression spring 64 is overcome and the valve member 76 lifted off surface 78 to allow fuel to pass by.

The solenoid 82 is mounted to a plate 86 secured to an end flange 88 by studs 90 and nuts 92. A cap 94 is secured over the solenoid 82 by capscrews 96 which are received in the end flange 88. Cap 94 includes a pilot bore 98 receiving the opposite end of the operator rod 84.

Leakage of fuel vapor past the actuator rod 44 and from bore 46 are collected via cross passage 104 and port 106 by a return fuel device 108 to prevent vapors passing the seals from reaching the solenoid 82.

The valve stem 74 includes a land slidably mounted in bore 42, and a reduced diameter portion 112 creating an annular clearance space 114 communicating with a cross bore 116 extending from bore 30 supplied with fuel. The land 110 creates a pressure balance, when the valve member 76 is closed, reducing the actuating forces, but biases the valve member 76 closed when opened to increase the speed of closing. The configuration of the converging surface 81 of the valve member 76 and diverging section 79 of a bore 118 downstream of the seat 78 is preferably designed to provide a uniform flow area to preclude a restriction effect on flow and resulting shock wave reflections and pressure losses.

Thus, when the valve member 76 is moved downwardly, pressurized fuel enters bore 118 formed in an electode holder 120, constructed to be electrically insulating as of 5030 TORLON.

Figure 3:
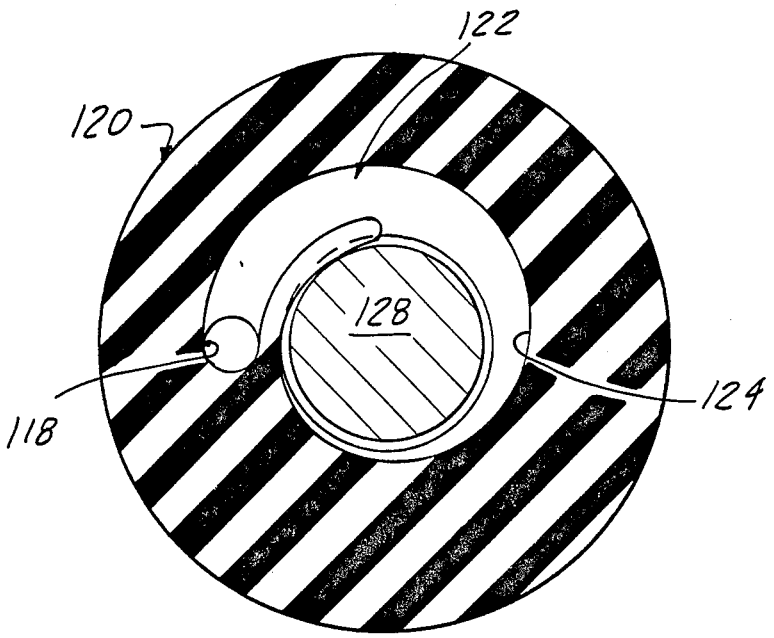
FIG. 3 is an enlarged view of the transverse section 3—3 taken in FIG. 2.

Bore 118 terminates in a spirally shaped recess 122 (FIG. 3) which converges about a bore 124 formed in a fitting 126 abutting against the electrode holder 120.

A first electrode 128 is fixed at one end in the electrode holder 120, receiving conductor 130 from cable 48 in socket 132, secured therein with set screw 134.

The first electrode 128 protrudes down into the bore 124 with an annular clearance space 136 defining an axial fuel flow passage. The spiral shape of recess 122 insures a uniform axial—tangential component of the fuel flow into the passage 136 to maintain the vortical flow therein to the maximum extent possible.

A second axially aligned electrode 138 has an upwardly extending tubular skirt portion 140 telescoped over the first electrode 128, with a clearance space 142 therebetween, also defining an annular fuel flow passage.

A shoulder formed by the rim 144 of an open-ended recess 154 is formed within the second electrode 138 and contacts the rim 145 of an open ended cavity 152 extending axially into the free end of the fixed electrode 128. An encircling spring 146 acts between a flange portion 148 and an interior end wall 150 of the retainer sleeve 38 to urge the second electrode upwardly to position rim 145 of the first electrode 128 into engagement with rim 144 of the second electrode 138.

The cavity 154 of the second electrode 138 terminates in end wall 156, and a series of tangential orifices 158 enable outflow of activated fuel into the combustion chamber 16. The tangential geometry takes advantage of the momentum of the vortical flow of the fuel (described below) to cause a forceful exit of the activated fuel into the combustion chamber 16.

Upon energization of the solenoid 82 and lowering of valve member 76 away from valve seat 78, pressurized fuel passes into bore 118, pressurizing spiral recess 122.

The pressure exerted by the fuel therein moves the movable second electrode 138 downwardly away from the relatively fixed upper electrode 128, unseating contact between the rim 145 and rim 144.

An electric current having previously been established along conductor 130, first electrode 128, and second electrode 138 by a circuit described hereinafter, an arc will be drawn, momentarily extending across the annular space or gap lying between the rounded edges of the rim 145 and rim 144.

Figure 5:
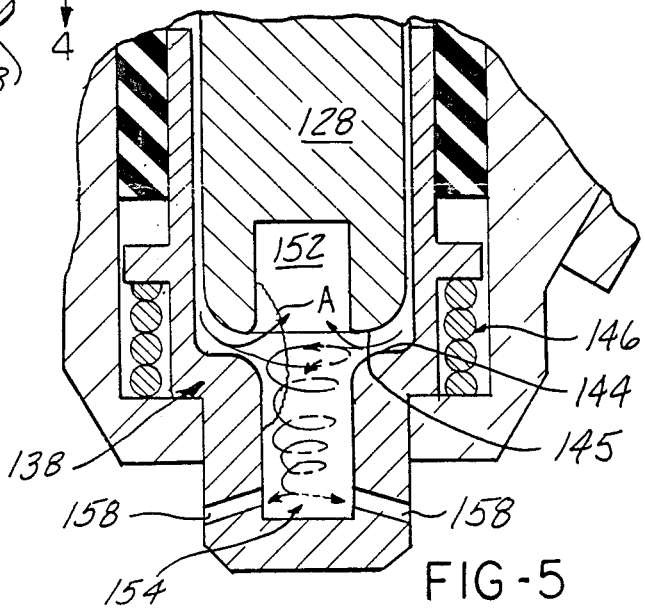
FIG. 5 is a further enlarged fragmentary sectional view of the electrode portions of the fuel injector.

Fuel flowing through spiral recess 122, sets up a vortical flow in annular space 142, which flows through the gap between the now separated first electrode 128 and second electrode 138, its fluid the momentum having a major tangential component as depicted in FIG. 5.

The inward direction of flow between rim 145 and rim 144 forces the arc (A) away from those surfaces. Re-entrant flow into cavity 152 pushes one end of the arc into cavity 152. The migrating arc thus extends from the surfaces of the cavities 152, 154 as shown in FIG. 5. The arc thus increases greatly in length.

It is noted that in order for the arc to have good mobility and respond to the aerodynamic force of the fuel flow, a gap of at least approximately 0.040 inches is desirable between the separated rims 144 and 145.

In addition, the tangential component of the fluid momentum of the fuel flow causes the arc to sweep around the annular space between the separated electrodes 128 and 138.

Combined with the tangential component of flow, this sweeping action greatly increases the proportion of fuel exposed to the intense activating effect of the electrical arc A.

At the same time, the constantly shifting or migrating location of either terminus of the arc A reduces the erosion of the surfaces as would occur with a fixed arc position.

Exit of the now activated fuel is preferably via the tangentially extending orifices 158 which utilize the momentum of the vortical fuel flow and disperse the activated fuel into the compressed air in combustion chamber 16. Combustion of the activated fuel is substantially instantaneous as it enters the oxidizing atmosphere, as described in the above cited patents.

Figure 6:
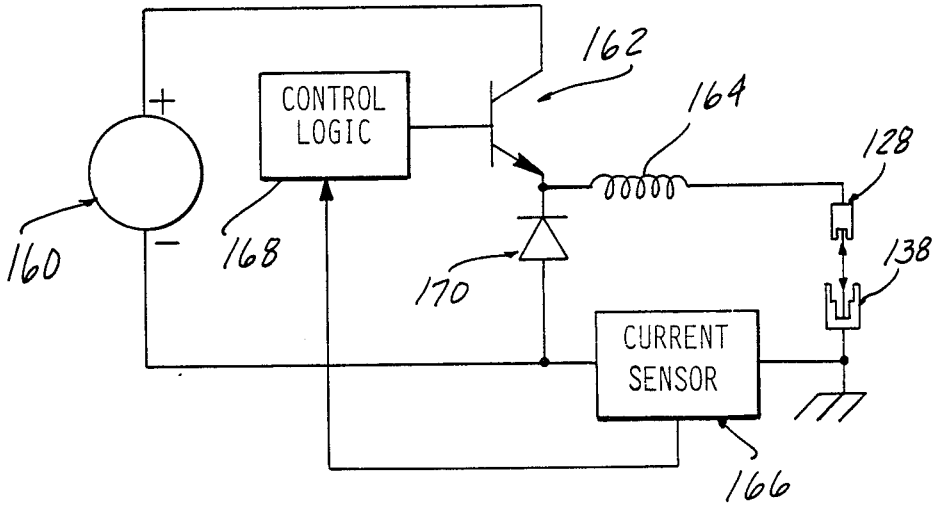
FIG. 6 is a diagrammatic view of the electrical arc driver circuit associated with the electrodes of the injector shown in FIGS. 1 and 2.

FIG. 6 shows a preferred arc driver circuit for sustaining the electrical arc, including a 0–300 v DC power supply connected across the electrodes 128, 138 via a Darlington power transistor 162 and a 3 millihenry "choke" coil 164.

Electrode 138 is connected into the circuit using the engine as circuit ground, and preferably the moving electrode 138 should be electrically connected solely via spring 146 to avoid establishment of sliding electrical contact with the contacting surfaces of the injector holder sleeve 38. For this purpose, bushing 126 should be constructed from an insulating material.

A current sensor 166 provides feed back to a pulse width modulated current level control logic circuit 168 connected to the base of the Darlington transistor 162 to limit the current across the electrodes 128, 138.

A diode 170 provides a return path for current to flow from choke coil 164 to electrodes 128, 138 as the transistor 162 is cycled to the off condition by circuit 168.

The choke coil 164 provides the increased voltage necessary to sustain the arc as the arc lengthens, since the decline in current itself generates a voltage due to the inductance of the coil 164.

The circuit 168 provides the basic timing and control of the current to the electrodes as desired for the particular application. Typically, engine crank rotation signals received from an encoder (not shown) would be utilized to time the onset of current for an internal combustion engine application.

In some instances it may be desirable to reduce the effects of the fuel flow impinging on the arc A, as where a too rapid a migration of the arc would otherwise occur, and in order to do this a bypassing flow path may be established.

Figure 7:
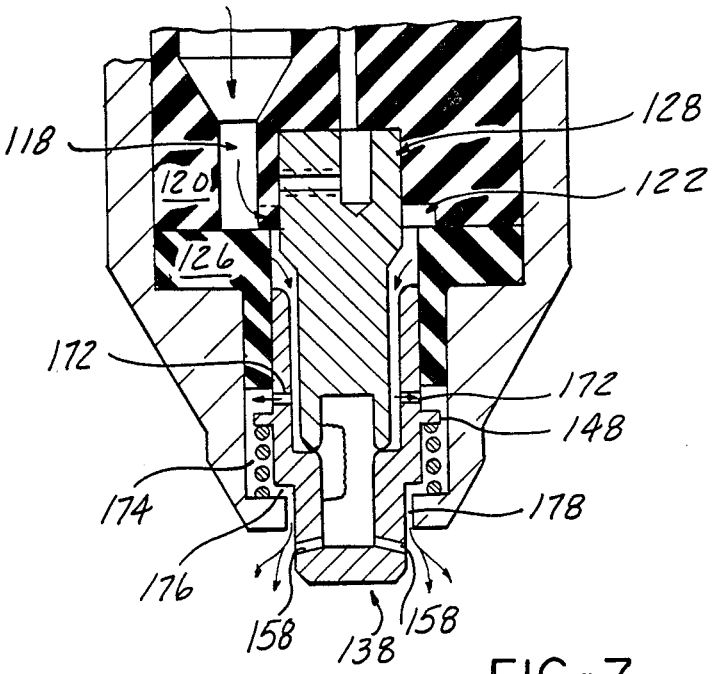
FIG. 7 is a fragmentary sectional view of an alternate embodiment of a fuel injector according to the present invention.

In a preferred form of this arrangement, shown in FIG. 7, a series of bypass holes 172 extend through the upper portion of the movable electrode 138 and pass into the space above the flange 148, and fuel may flow past the flange 148 into the spring cavity 174, through a clearance space 176 maintained when the electrodes 128, 138 are separated and out through a clearance space 178 between the OD of the lower portion of movable electrode 138 and retainer sleeve 38. This flow is adjacent the orifices 158 to thus mix the unactivated fuel with the activated fuel as it enters the combustion chamber 16.

Figure 8:
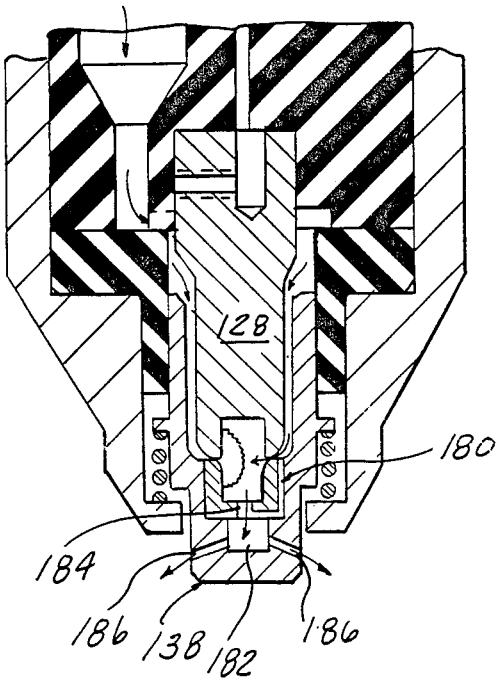
FIG. 8 is ~~a~~ fragmentary sectional view of a variation of the alternate embodiment shown in FIG. 7.

A variation of this embodiment is shown in FIG. 8, in which a series of axial bypass channels 180 extend through the shoulder 144 of electrode 138, entering into a mixing chamber downstream of a central port 184 through which the activated fuel passes. The mixture then exits via jet orifices 186. Results are less favorable with this arrangement, and hence the above described version is preferred.

The above described apparatus and method for activating fuel may be applied to various fuels, and in various combustion devices, although having particular advantage with internal combustion engines since being capable of rapidly activating a relatively large quantity of fuel by electrical means.

While a vortical flow of fuel is described as the means for sweeping the arc around a flow gap, a field coil could be employed for this same purpose arranged concentrically to an electrode, so as to augment the force of the vortical flow on the arc or as an alternative.

Thus it may be appreciated that the above described apparatus and method achieves the object of the invention in that a substantial proportion of a fuel charge may be effectively exposed to the activating effects of an electrical arc by sustaining the arc and sweeping it through a vortical flow of fuel passing through an annular arc gap. The low current and continuously migrating arc mitigates the tendency for electrode erosion and achieves a good mixing of the radicals. Since these radicals have a short period of persistence, the generation of these radicals at the point of injection is an important advantage of the invention.

We claim:

1. An apparatus for activating a vaporized or gaseous fuel by the formation of molecular radicals prior to introduction into an oxidizing atmosphere, whereat substantially instantaneous combustion of said fuel may occur, the apparatus comprising:

a fuel flow passage adapted to receive pressurized fuel from a source;

means for establishing a sustained electrical arc across said fuel-flow passage for a substantial part of the period when fuel is flowing therethrough, including a pair of electrodes having opposing portions positioned on either side of said flow passage and also including means for causing current to flow between said electrodes;

means causing said sustained electrical arc to substantially continuously migrate about said flow passage as said fuel is flowing in said passage, whereby the ends of said electrical arc at each electrode are shifted about during said period of fuel flow.

2. The apparatus according to claim 1 wherein said flow passage comprises an annular space defined between said electrodes and further including means for establishing a vortical flow of fuel about said annular space; said opposing electrode portions comprising annular surfaces between which said electrical arc is established and sustained, and wherein said means causing said arc to continuously migrate causes said electrical arc to migrate around said annular surfaces.

3. The apparatus according to claim 1 wherein said means causing said electrical arc to migrate along said flow passage comprises means directing said fuel flow to impinge on said arc.

4. The apparatus according to claim 2 wherein each of said electrodes is formed with open-ended recessed cavities having rims facing each other, said annular space defined between the rims of said cavities.

5. The apparatus according to claim 1 wherein said electrodes are mounted to be relatively movable towards and away from each other, and means urging said electrodes into initial contact with each other, and means separating said electrodes upon initiation of said fuel flow to create a space therebetween, said space defining said fuel flow passage; said means for causing current to flow between said electrodes causing said current to flow while said electrodes are in initial contact and after said separation, whereby an arc is established by separation of said electrodes with said current flow.

6. The apparatus according to claim 5 wherein said means separating said electrodes comprises means for exerting the pressure of said fuel on at least one of said electrodes to cause said separation.

7. The apparatus according to claim 2 wherein said means for establishing vortical flow comprises a spiral recess surrounding said electrodes immediately adjacent and convergent to said annular space defining said flow passage, and means for introducing tangential fuel flow into said spiral recess.

8. The apparatus according to claim 4 wherein one of said electrodes is formed with a series of tangentially extending jet orifices adapted to direct activated fuel out of said cavity.

9. The apparatus according to claim 1 further including bypass flow passage means directing a portion of fuel flow through said apparatus without passing through said flow passages wherein said electrical arc is sustained, whereby a portion of said fuel is not directed through said arc.

10. The apparatus according to claim 9 further including means for mixing flow through said bypass flow passage means with activated fuel passed over said electrical arc.

11. A method of activating a quantity of fuel prior to combustion in an oxidizing atmosphere comprising the steps of:

establishing an electrical arc within a space defined between two electrodes;

passing said quantity of fuel through said space while sustaining said arc in said space to activate a substantial portion of said quantity of fuel;

shifting said arc through said space as said fuel is flowing through said space so that the ends of said arc shift substantially continuously.

12. The method according to claim 11 wherein said arc is established by initially relatively positioning said electrodes in contact together while establishing a current therebetween and thereafter separating said electrodes while continuing applying said current to establish said arc.

13. The method according to claim 11 wherein said space is annular and including the step of establishing a vortical fuel flow in said space to have a fluid momentum component directed tangentially therein, said arc established across said space and shifted around said annular space during said fuel flow.

14. The method according to claim 11 wherein said step of shifting said electrical arc comprises blowing said arc by fuel flowing against said arc.

15. The method according to claim 13 wherein said electrodes each include an open cavity facing each other with the rim portions thereof brought into initial contact prior to establishing said arc, and wherein said arc is shifted around and within said cavities by said vortical fuel flow.

16. The method according to claim 12 wherein said electrodes are separated by the step of exerting the pressure of the fuel thereon.

17. The method according to claim 15 further including the step of directing fuel out from a cavity in one of said electrodes through a series of tangentially extending jet orifices.

18. The method according to claim 14 further including the step of bypassing a portion of said fuel from said space and thereafter mixing said bypassed fuel into said activated fuel passed through said arc.

19. In combination a combustion device and a fuel injector for cyclically injecting activated fuel into a combustion chamber of said combustion device in which chamber a charge of fuel is burned in an oxidizing atmosphere established in said combustion chamber, wherein said injector is characterized by:

an injector housing having a tip portion adapted to be mounted into said combustion chamber;

first and second electrodes mounted in said tip portion, said electrodes during injection spaced apart to form a gap, and defining in part a fuel flow passage;

means for controllably supplying a quantity of vaporized or gaseous fuel to said flow passage during each injector cycle to cause fuel to flow therethrough;

arc driver circuit means for establishing a sustained electrical arc across said gap while said fuel is flowing during each injection cycle to activate said quantity of fuel injection port means for directing said fuel flowing through said gap out of said injector tip and into said engine combustion chamber, said activated quantity of fuel igniting upon entering said combustion chamber.

20. The fuel injector and combustion device combination according to claim 19 wherein said combustion device comprises an internal combustion engine.

21. The fuel injector and combustion device combination according to claim 19 wherein said first and second electrodes are relatively movably mounted in said tip portion between a first position in contact with each other and a second position spaced apart to form said gap, and further including positioning means for positioning said first and second electrodes in contact preparatory to each injection cycle and separating means separating said electrodes at the beginning of each injection cycle.

22. The fuel injector combustion device combination according to claim 21 wherein said positioning means comprises a spring urging one of said electrodes into said engagement with the other electrode, and said separation means comprises means applying the fluid pressure of said quantity of fuel on said one electrode so as to cause said spring to be overcome.

23. The fuel injector and combustion device combination according to claim 21 wherein said arc driver circuit means applies a current to said first and second electrodes while said electrodes are in contact, whereby an arc is drawn as said electrodes are separated.

24. The fuel injector and combustion device combination according to claim 23 wherein said arc driver circuit voltage is in the range of 200–800 volts.

25. The fuel injector and combustion device combination according to claim 23 further including means for causing said arc to migrate about said gap during each injection cycle.

26. The fuel injector and combustion device combination according to claim 25 wherein said gap comprises an annular space and said means for causing said arc to migrate about said annular gap causes said arc to rotate around said annular space.

27. The fuel injector and combustion device combination according to claim 26 wherein said means for causing said arc to migrate comprises means directing said fuel flow against said arc to cause said rotation.

28. The fuel injector and combustion device combination according to claim 27 wherein said means directing said fuel flow includes means establishing a vortical flow of fuel.

29. The fuel injector and combustion device combination according to claim 28 wherein said means establishing a vortical flow comprises a spiral recess disposed about one of said electrodes immediately upstream and aligned with said annular space.

* * * * *